US005735679A

United States Patent [19]

Hutchins

[11] Patent Number: 5,735,679

[45] Date of Patent: Apr. 7, 1998

[54] DEVICE HAVING POROUS ROTOR OF SINTERED METAL CONTAINING POLYTETRAFLUOROETHYLENE

[75] Inventor: Donald H. Hutchins, Sierra Madre, Calif.

[73] Assignee: Hutchins Manufacturing Co., Pasadena, Calif.

[21] Appl. No.: 570,832

[22] Filed: Dec. 12, 1995

Related U.S. Application Data

[63] Continuation-in-part of Ser. No. 387,561, Feb. 13, 1995, abandoned.

[51] Int. Cl.[6] ..... F01C 21/00

[52] U.S. Cl. ..... 418/179; 418/133; 428/551

[58] Field of Search ..... 418/133, 179, 418/266; 428/539.5, 546, 551, 565

[56] References Cited

U.S. PATENT DOCUMENTS

| | | | |
|---|---|---|---|
| 3,705,450 | 12/1972 | Morisaki | 428/551 |
| 4,380,270 | 4/1983 | Ludwig | 418/266 |
| 4,415,321 | 11/1983 | Okazaki | 418/179 |
| 4,666,787 | 5/1987 | Bickle | 428/551 |
| 4,767,677 | 8/1988 | Kuwayama | 428/551 |
| 4,804,317 | 2/1989 | Smait et al. | 418/179 |
| 4,820,140 | 4/1989 | Bishop | 418/179 |
| 4,923,761 | 5/1990 | Shindo | 428/551 |
| 4,986,036 | 1/1991 | Hutchins . | |
| 5,253,990 | 10/1993 | Hutchins . | |

OTHER PUBLICATIONS

Military Standard MIL –STD –276 entitled "Military Standard Impregnation of Porous Nonferrous Metal Castings".

"DSM" Brochure describes a plastic sold under the trademark Stanyl.

*Primary Examiner*—Charles G. Freay

*Attorney, Agent, or Firm*—Darby & Darby, P.C.

[57] ABSTRACT

A motor driven by air or other fluid, or a pump for pumping air or another fluid, including a rotor having a porous metal body formed of compacted and sintered metal particles and containing polytetrafluoroethylene embedded within the pores of the body. The metal particles are preferably primarily of iron, with a smaller amount of copper at least partially dissolved in the iron. The metal body carries vanes which are received slidably within slots in the body and are movable radially relative thereto and are preferably formed of resinous plastic material.

17 Claims, 9 Drawing Sheets

DEVICE HAVING POROUS ROTOR OF SINTERED METAL CONTAINING POLYTETRAFLUOROETHYLENE

This application is a continuation-in-part of application Ser. No. 08/387,561 filed on Feb. 13, 1995, now abandoned.

This invention is concerned primarily with the provision of improvements in rotory air driven motors such as for example those used in portable power driven sanding tools or other powered tools. Some features of the invention may also be applicable to other types of equipment in which it may be desirable to provide relatively moving parts which are self lubricating.

BACKGROUND OF THE INVENTION

Certain types of sanders currently on the market include a motor having a rotor assembly which is driven by compressed air and which includes a rotor body and a number of vanes received slidably within slots in the body and adapted to move radially relative thereto as the body turns. Unless the rotor body and vanes of such a device are lubricated in some way, they tend to wear rapidly in use. It is therefore customary at appropriate intervals to introduce oil into the flow of air delivered to the tool in order to extend the operating life of the tool. This necessity for injection of oil into the air stream requires the provision of extra equipment for introducing the oil, and is also inconvenient and time consuming. Attempts have been made to avoid the requirement for such lubrication of air motors, but I know of none which has been as successful as would be desired.

SUMMARY OF THE INVENTION

A purpose of the present invention is to provide an improved type of rotor for an air motor or other rotary device such as a pump, which rotor does not require lubrication and thus avoids the difficulties encountered heretofore in feeding oil into the air line to the device. To attain this result, a motor or other rotary device embodying the invention includes a rotor with a porous metal body formed of sintered metal and having polytetrafluoroethylene, for example Teflon as sold by E. I. DuPont de Nemours, embedded within the pores of the body. The porous body is initially formed by pressing together a mass of metal particles and then heating the part, preferably to a temperature melting some of the metal to effectively integrate the body. The body may then be subjected to a vacuum to remove air from the pores of the body, and then immersed in liquid polytetrafluoroethylene while under vacuum, after which the liquid may be pressurized to force it into the pores, with the part ultimately being heated to harden the polytetrafluoroethylene in its pores. The metal particles of the sintered rotor body may be primarily iron, with a smaller amount of copper which may go into solution in the iron during the heating process. If the rotor has vanes of the type previously described, those vanes are preferably formed of resinous plastic material, and are in contact with some of the polytetrafluoroethylene within the vane mounting slots in the rotor body.

BRIEF DESCRIPTION OF THE DRAWINGS

The above and other features and objects of the invention will be better understood from the following detailed description of the typical embodiment illustrated in the accompanying drawings, in which.

DESCRIPTION OF THE PREFERRED EMBODIMENT

Figure 1A:
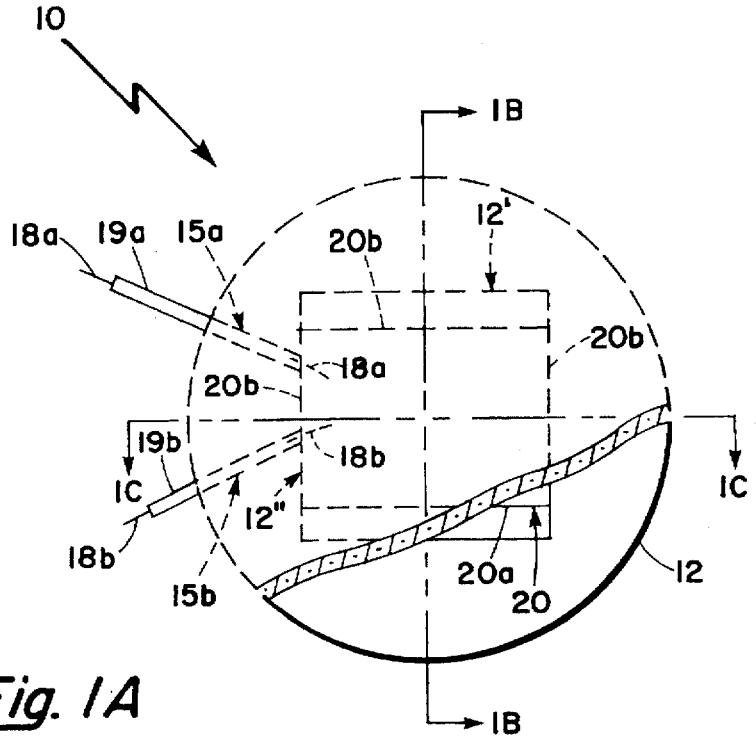
FIG. 1 is a side elevational view of an orbital sander containing an air motor incorporating the features of the present invention.
Figure 1C:
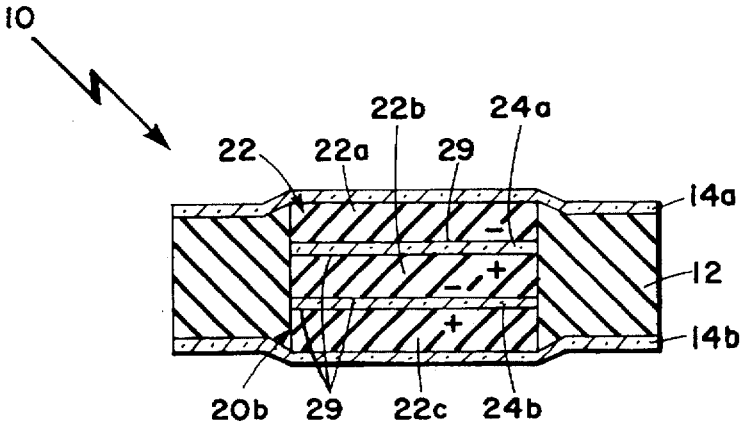
Figure 1B:
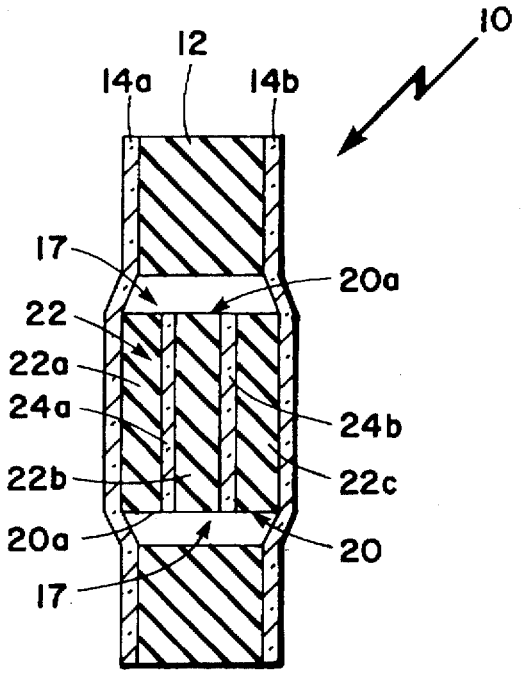
Figure 2:
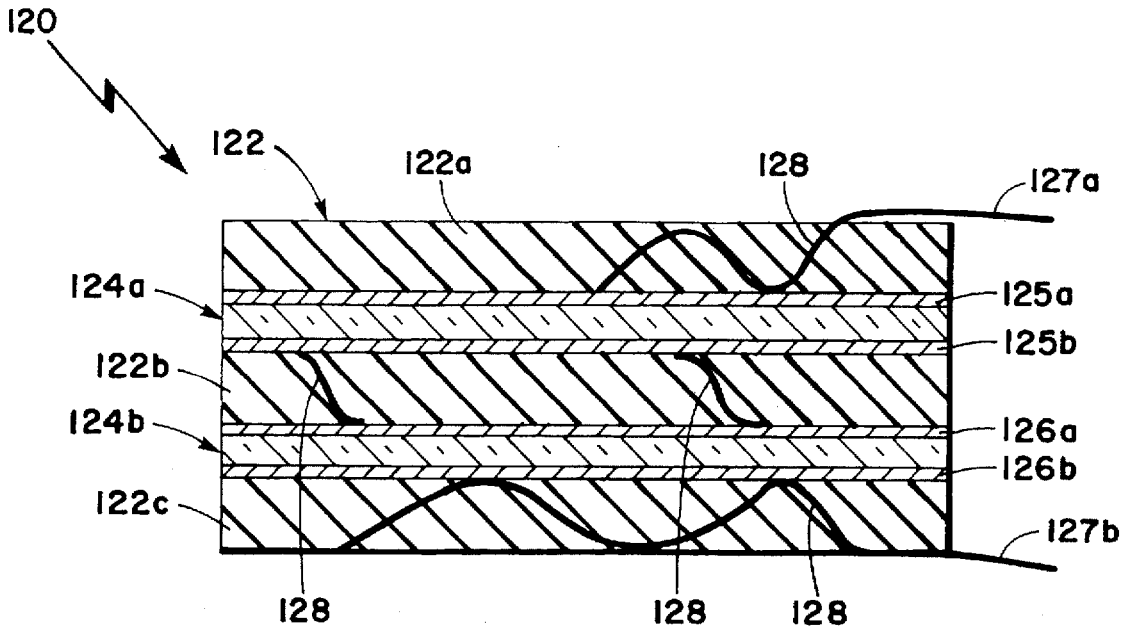
FIG. 2 is an enlarged fragmentary horizontal section through the air motor of the FIG. 1 tool, taken on line 2—2 of FIG. 1.
Figure 3D:
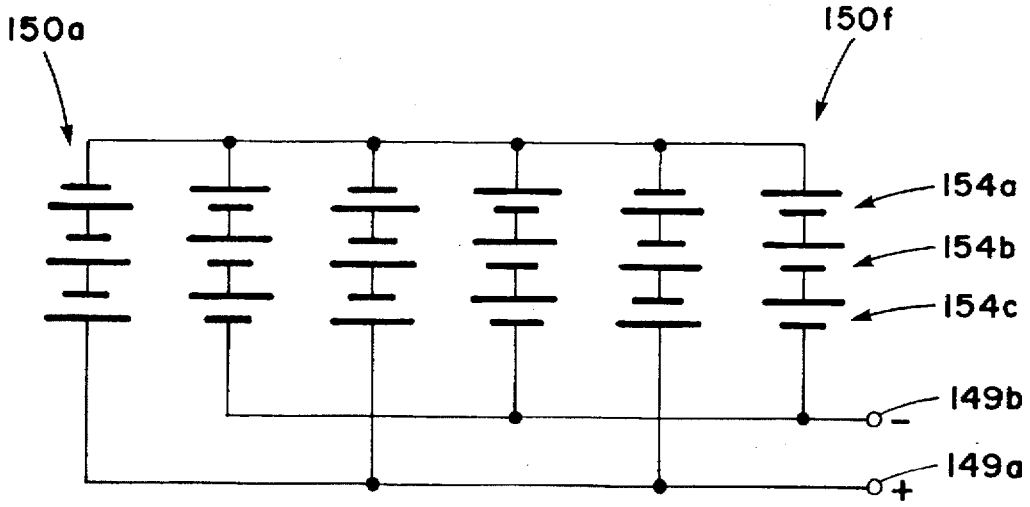
FIG. 3 is a fragmentary vertical section taken on line 3—3 of FIG. 2.
Figure 3A:
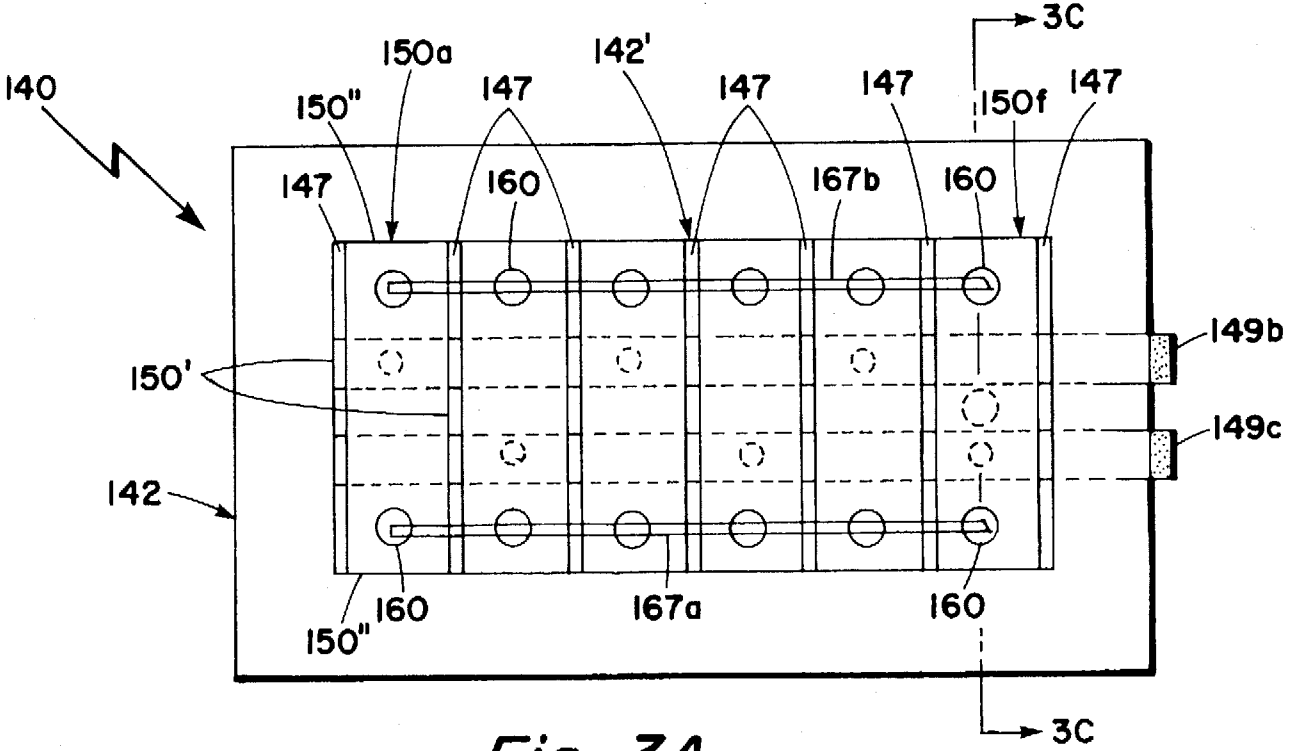
Figure 3B:
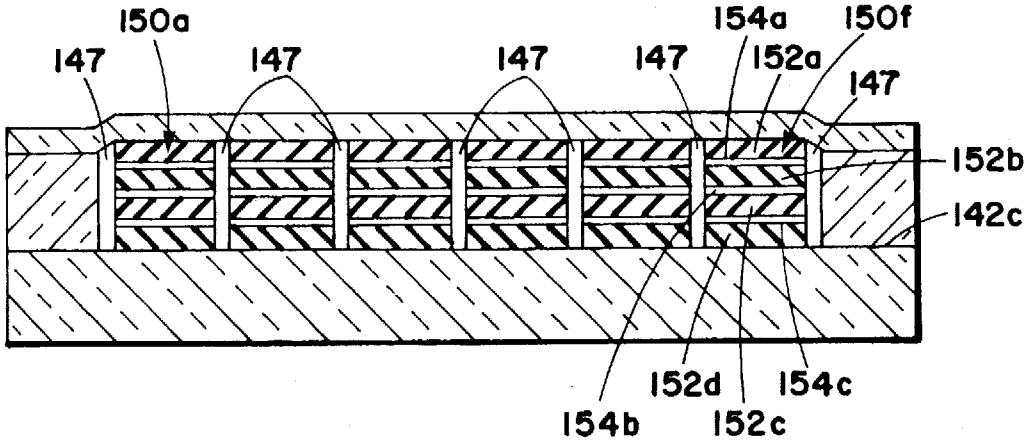
Figure 3C:
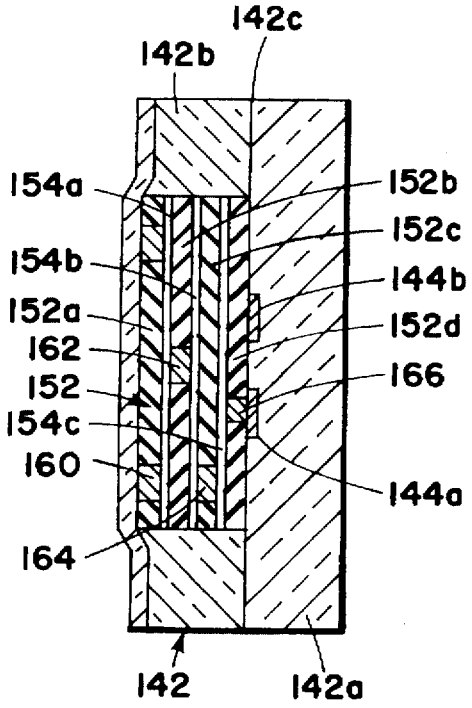
Figure 4A:
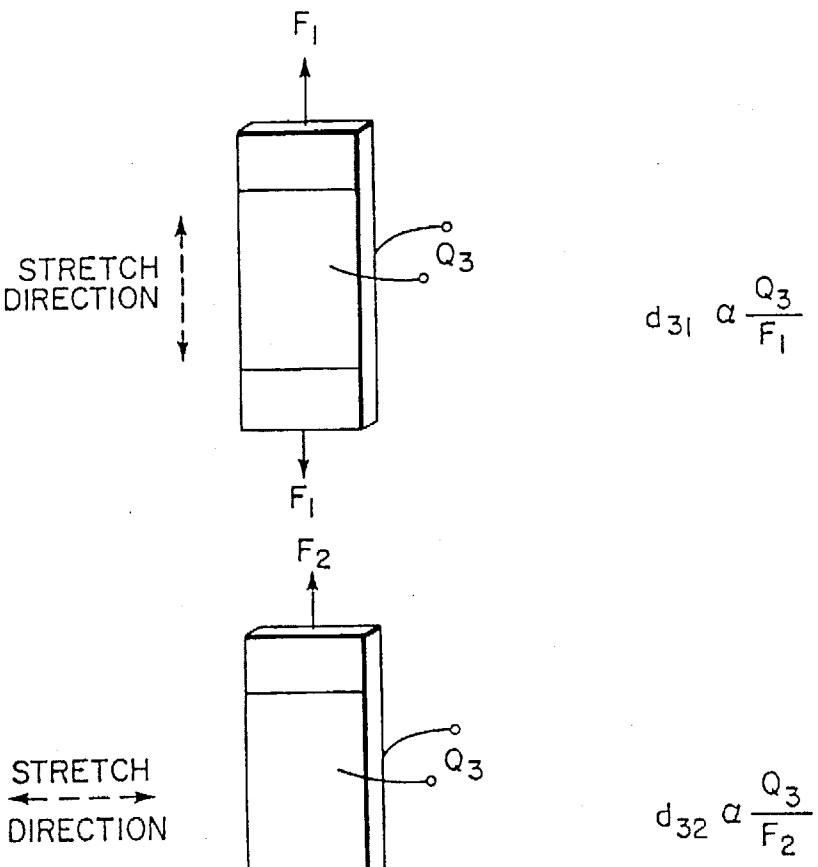
FIG. 4 represents diagrammatically a step in the formation of the rotor body.
Figure 4B:
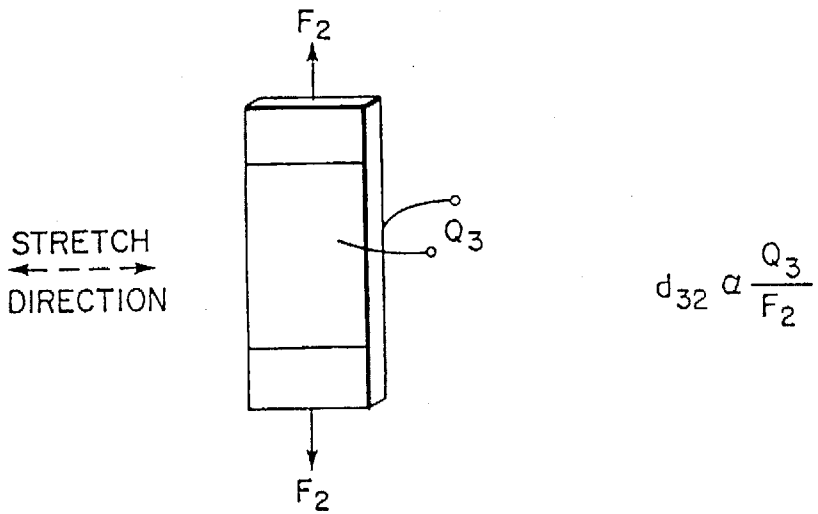
Figure 4C:
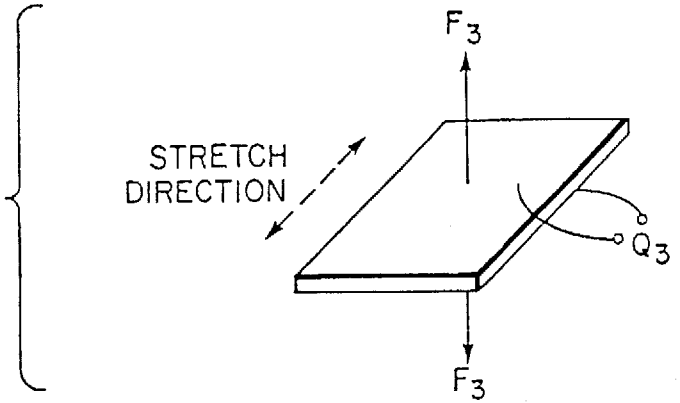
Figure 4D:
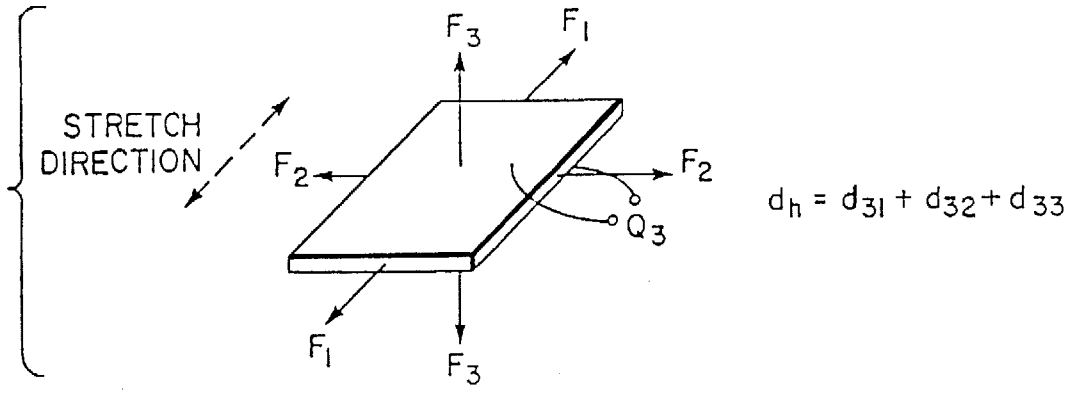

The sander 10 illustrated in FIG. 1 includes a body 11 shaped as a handle to be held by a user in moving the tool along a work surface 12 to abrade that surface. An air driven motor 13 having a rotor constructed in accordance with the present invention is contained within body 11 of the tool and acts through an orbital drive connection 14 to move a sanding head 15 and carried sheet of sandpaper 16 orbitally about the vertical axis 17 of the motor, to abrade the work surface 12. Air is supplied to motor 13 from a source 18 of compressed air.

Body 11 of the tool may be formed as an assembly of parts including a hollow rigid metal body part 19 having a cylindrical internal surface 20 defining a recess within which motor 13 is received. Part 19 may be externally square, and may have an annular horizontal flange 21 at its upper end retaining the motor against upward removal from the body. The motor is retained at its underside by a part 22 which is secured rigidly in any appropriate manner to part 19, and which has a shoulder 23 engaging the bottom of the motor. The lower portion of member 22 may be connected by an annular clamp 24 to a tubular rubber boot 25 which is disposed about orbital drive connection 14 and whose lower end is connected to sanding head 15 to retain it against rotation while permitting orbital movement of head 15 and its carried sandpaper.

The non-rotating stator or housing assembly 26 of motor 13 includes a number of parts clamped vertically between flange 21 and shoulder 23. These parts of housing assembly 26 include a vertically extending side wall 27, a top wall 28 carrying a bearing 29, a bottom wall 30 carrying a bearing 31, and two horizontal circular top and bottom wear plates 32 and 33. A rotor 34 is contained within the cylindrical motor chamber 35 formed by housing parts 27, 28, 30, 32 and 33, and is connected to a shaft 36 which turns with the rotor about vertical axis 17 and drives head 15 through orbital connection 14.

Side wall 27 of the motor assembly has a vertical cylindrical inner surface 37 which is eccentric with respect to main axis 17 of the motor, and is centered about a vertical axis 38 offset from and parallel to axis 17, and which may be referred to as a peripheral wall of chamber 35. A flange 39 on shaft 36 bears upwardly against the inner race of lower bearing 31, and a washer 40 retained by a screw 41 connected to the shaft bears downwardly against the inner race of upper bearing 29.

Rotor 34 has a vertical cylindrical external surface 42 centered about axis 17, and carries a series of vanes 43 received slidably within radial slots 44 in the rotor and engageable with the eccentric internal surface 35 of side wall 27 of the motor chamber. Because of the eccentric relationship between the stator and rotor of the motor, the compartments circularly between successive vanes 43 progressively change in size as the rotor turns. Air is introduced into these compartments through an inlet passage 45 in the side wall of the motor under the control of a manually actuated air inlet valve 46 to cause rotation of the rotor. Air leaves the motor chamber through an outlet opening 145. The upper and lower surfaces 134 and 135 of rotor 34 and the corresponding upper and lower surfaces of vanes 43 are horizontal and slidably engage top and bottom wear plates 32 and 33.

In accordance with the teachings of the present invention, rotor 34 is formed of porous metal having polytetrafluoroethylene impregnated into its pores. The pores of the rotor body preferably occupy between about 20 and 30 percent of the total volume of the rotor body, for best results approximately 25 percent. These pores extend through the entire thickness and radial extent of the rotor body, and are preferably completely filled with the polytetrafluoroethylene.

Referring now to FIG. 4, the metal of rotor 34 is first provided in the form of a finely divided powder represented at 55 in that figure. A measured quantity of the powder is placed within a cavity in a mold 56, and is compressed vertically between top and bottom pressure members 47 and 48 which move vertically toward one another and into upper and lower portions of the cavity 49 in die 56, to press the powdered metal into the desired shape of the rotor 34. As will be understood, the parts 56, 47 and 48 are configured to mold the particulate metal to the shape of the rotor 34, including formation of the radial slots 44 in the rotor. The powder may be cold pressed, desirably at a very high pressure, such as thirty five tons per square inch. The metal powder may typically be about one hundred mesh in particle size, and may be dendritic, that is, irregular in particle configuration.

In the presently preferred process, the metal particles from which rotor 34 is formed are primarily iron, with a smaller amount of copper intimately intermixed with and distributed throughout the iron. Desirably, the particles include 90 percent reduced iron particles (sponge iron) and 10 percent copper particles.

After the rotor body has been pressed to the proper configuration, that body is placed in a furnace and heated to a sintering temperature, causing the copper to go into solution in the iron, and thus further integrating the components of the body. The sintering temperature is desirably about 2050 degrees Fahrenheit, and is performed in an atmosphere which will exclude oxygen from contact with the rotor body. That atmosphere may for example be 75 percent hydrogen and 25 percent nitrogen.

Figure 5:
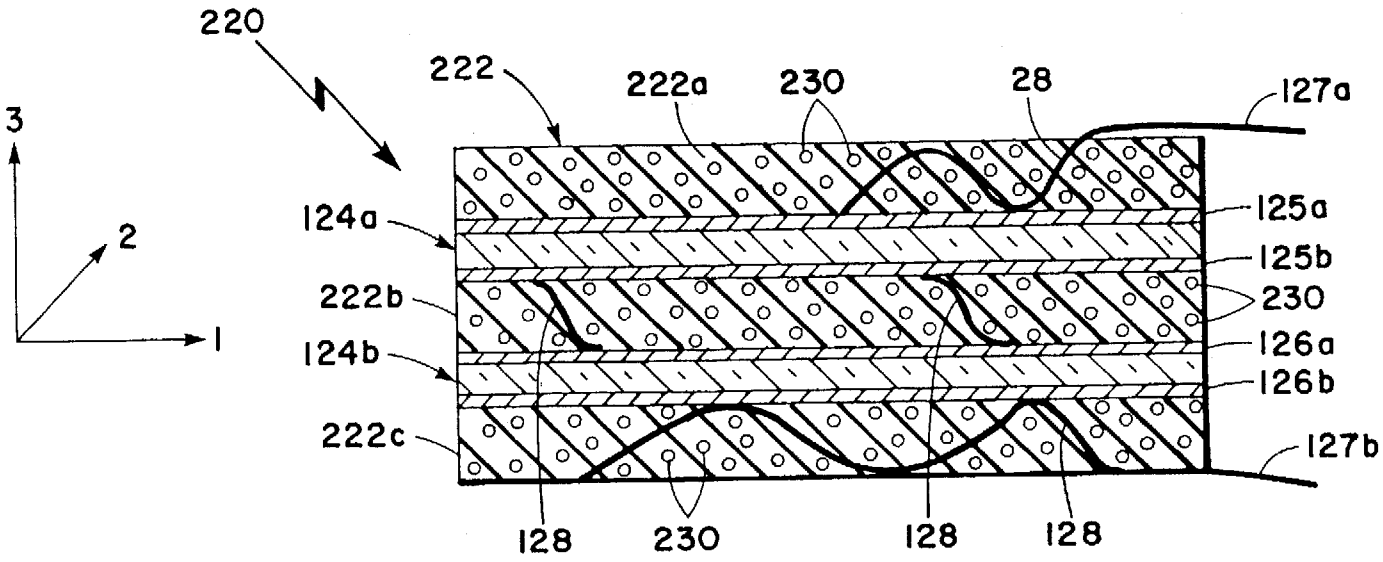
FIG. 5 represents diagrammatically a step in the process of impregnating polytetrafluoroethylene into the porous rotor body.

FIG. 5 represents diagrammatically the manner in which the rotor body 34 may be impregnated with polytetrafluoroethylene after the body has been heated to sintering temperature and then cooled. To attain such impregnation, the rotor body is placed in an initially empty fluid tight chamber or tank 51, after which air is withdrawn from the chamber by a vacuum pump 151 to draw air out of the pores of the rotor body. The vacuum is desirably between about 26 and 30 inches of mercury, and is maintained for at least about 30 minutes. Liquid polytetrafluoroethylene, represented at 50 in FIG. 5, is then introduced slowly into the chamber from a source 52, while maintaining the vacuum in the chamber, and until the liquid completely immerses the part and rises to a level several inches above it, say six inches. The air space above the liquid is then pressurized by a pump 53, preferably to a pressure of at least about 100 pounds per square inch for at least one hour to force the polytetrafluoroethylene deeply into the pores of the rotor body. The liquid in which the rotor is immersed is an aqueous dispersion of colloidal polytetrafluoroethylene particles, which dispersion is highly fluid at room temperature and capable of easily flowing into the minute pores of the sintered metal rotor. The presently preferred material for the purpose is that sold by E. I. Dupont de Nemours as Teflon FJVP 02907, Type 301.

After the impregnation process described above has been completed, with polytetrafluoroethylene substantially filling all of the pores in the rotor body, that body is placed within an oven, and baked for a period long enough to completely harden the polytetrafluoroethylene within the pores, preferably for a period of one hour at a temperature of 250 degrees Fahrenheit. In the final product the sintered metal of the rotor body preferably occupies about 70 to 80 percent of the volume of the part, and the polytetrafluoroethylene occupies about 20 to 30 percent of the that volume, desirably 25 percent.

The vanes 43 of the rotor assembly are formed of resinous plastic material, of a type capable of withstanding wear during operation of the motor. The presently preferred material is polytetramethylene adipamide or polyamide 46, as sold by DSM, Postbus 3204, 3502 GE UTRECHT, Nederland, under the trademark "Stanyl".

Wear plates 32 and 33 are formed of a material which is harder than the material of rotor body 34 and its vanes 43, and harder than the material of parts 27, 28 and 30 of the motor housing. Preferably, plates 32 and 33 are formed of spring steel, having a Rockwell hardness of at least about forty-five on the C scale, desirably forty-nine on that scale.

It is found that a motor constructed as described above, with its rotor 34 being formed of sintered metal impregnated with polytetrafluoroethylene as described, can operate effectively over a very long useful life without noticeable wear on the rotor body 34 or vanes 43 or wear plates 32 and 33 or the peripheral part 27 of the housing. Introduction of oil into the air supply to such a motor is completely unnecessary. Bearings 29 and 31 can be of a known self lubricating type, containing permanently retained grease, with the result that the entire tool is then capable of functioning without lubrication by the user.

The polytetrafluoroethylene which is embedded within and fills the pores of the sintered metal of opposite side walls 144 of slots 44 effectively lubricates the sliding engagement between those walls and the vanes. Since the entire area of each of the slot side walls 144 is formed by the porous sintered metal of the rotor body and the polytetrafluoroethylene adhered to the sintered metal and embedded within its pores, there is substantially no wear of either the slot walls or the vanes.

Additional advantages are attained because the outer cylindrical surface 42 of rotor 34, and the opposite end surfaces 134 and 135 of the rotor are also formed, over their entire areas, by the porous sintered metal of the rotor body and the polytetrafluoroethylene adhered thereto and embedded within its pores. Thus, the contact of the portions of surface 42 between successive vanes with wall 35, and the contact of end surfaces 134 and 135 of the rotor with plates 32 and 33, is fully and effectively lubricated. There is consequently no necessity for the usual practice of periodically injecting an oil mist into the air fed to the motor to prevent wear of its parts.

It is contemplated that some of the features of novelty of the rotor 34 of the above described apparatus may be applied to other types of parts in which advantages may be attained by forming the parts of porous sintered metal impregnated with polytetrafluoroethylene as described.

While a certain specific embodiment of the present invention has been disclosed as typical, the invention is not limited to this particular form, but rather is applicable broadly to all such variations as fall within the scope of the appended claims.

I claim:

1. A rotary fluid device comprising:

a housing containing a chamber through which fluid flows; and a rotor in said chamber which rotates therein in accordance with the rate of fluid flow through the chamber;

said rotor including a body of porous metal formed of compacted and sintered metal particles and having polytetrafluoroethylene embedded within its pores;

said sintered metal particles of the rotor body being approximately 90% iron and approximately 10% copper at least partially dissolved in the iron.

2. A rotary fluid device comprising:

a housing containing a chamber through which fluid flows; and a rotor in said chamber which rotates therein in accordance with the rate of fluid flow through the chamber;

said rotor including a body of porous metal formed of compacted and sintered metal particles and having polytetrafluoroethylene embedded within its pores;

said rotor body being mounted eccentrically in said chamber and having vanes slidably received in slots in the rotor body and contacting said polytetrafluoroethylene of the rotor body within said slots;

said vanes being formed of polytetramethylene adipamide or polyamide 46.

3. A rotary fluid device comprising:

a housing containing a chamber through which fluid flows;

a rotor body in said chamber which rotates therein in accordance with the rate of fluid flow through the chamber; and vanes slidably received within slots in the rotor body;

said vanes being formed of polytetramethylene adipamide or polyamide 46.

4. A rotary fluid device comprising:

a housing containing a chamber through which fluid flows;

a rotor body in said chamber which rotates therein in accordance with the rate of fluid flow through the chamber; and vanes slidably received within slots in the rotor body;

said rotor body being formed of porous metal composed of compacted and sintered metal particles and having polytetrafluoroethylene embedded within its pores;

said rotor body having surfaces within said slots at opposite sides of the vanes which are slidably engaged by the vanes and which, over the major portion of the area of contact between said rotor body and the vanes, are formed of said sintered metal particles with polytetrafluoroethylene embedded in pores between the particles and contacting the vanes;

said sintered metal particles of the rotor body being approximately 90% iron and approximately 10% copper at least partially dissolved in the iron.

5. A rotary fluid device comprising:

a housing containing a chamber through which fluid flows from an inlet to an outlet;

a rotor body in said chamber which rotates therein about an eccentric axis in accordance with the rate of fluid flow through the chamber;

said rotor body containing circularly spaced slots opening outwardly toward a peripheral wall of the chamber; and vanes mounted slidably within said slots and projecting outwardly into engagement with said peripheral wall of the chamber to define a series of fluid compartments between the vanes which change progressively in volume as the rotor turns;

said rotor body, along the major portion of its axial length, being formed of porous metal composed of compacted and sintered metal particles;

said rotor body having polytetrafluoroethylene embedded within at least some of its pores, between said particles;

said slots in the rotor body having side walls at opposite sides of the vanes which are slidably engaged by the vanes to guide the vanes for movement inwardly and outwardly relative to the rotor body, and which, over the major portion of the area of contact between said rotor body and the vanes, are formed by said compacted and sintered metal particles and polytetrafluoroethylene adhered to the particles and embedded in pores between the particles and contacting the vanes.

6. A rotary fluid device as recited in claim 5, in which said side walls of the slots are formed by said compacted and sintered metal particles and polytetrafluoroethylene in pores between the particles over substantially the entire area of contact between the rotor body and the vanes.

7. A rotary fluid device as recited in claim 5, in which said rotor body is formed of said compacted and sintered metal particles through substantially the entire axial length of the rotor body.

8. A rotary fluid device as recited in claim 5, in which said rotor body is formed of said compacted and sintered metal particles, and has polytetrafluoroethylene within pores between the particles, through substantially the entire axial length of the rotor body.

9. A rotary fluid device as recited in claim 8, in which said side walls of the slots are formed by said compacted and sintered metal particles and polytetrafluoroethylene in pores between the particles over substantially the entire area of contact between the rotor body and the vanes.

10. A rotary fluid device as recited in claim 5, in which said rotor body is formed of said compacted and sintered metal particles through substantially the entire axial length of the rotor body and through substantially its entire radial thickness at all points along said length.

11. A rotary fluid device as recited in claim 5, in which said rotor body is formed of said compacted and sintered metal particles, and has polytetrafluoroethylene within pores between the particles, through substantially the entire axial length of the rotor body and through substantially its entire radial thickness at all points along said length.

12. A rotary fluid device as recited in claim 11, in which said side walls of the slots are formed by said compacted and sintered metal particles and polytetrafluoroethylene in pores between the particles over substantially the entire area of contact between the rotor body and the vanes.

13. A rotary fluid device as recited in claim 5, in which said rotor body has radially outer surfaces circularly between said slots which face radially outwardly toward said peripheral wall of the chamber, and which are formed by said compacted and sintered metal particles and polytetrafluoroethylene adhered to the particles and embedded in pores between the particles.

14. A rotary fluid device as recited in claim 5, in which said rotor body has opposite end surfaces which are formed by said compacted and sintered metal particles with polytetrafluoroethylene adhered to the particles and embedded in pores between the particles.

15. A rotary fluid device as recited in claim 13, in which said rotor body has opposite end surfaces which are formed by said compacted and sintered metal particles with polytetrafluoroethylene adhered to the particles and embedded in pores between the particles.

16. A rotary fluid device as recited in claim 15, in which said rotor body is formed of said compacted and sintered metal particles, and has polytetrafluoroethylene within pores between the particles, through substantially the entire axial length of the rotor body.

17. A rotary fluid device as recited in claim 15, in which said rotor body is formed of said compacted and sintered metal particles, and has polytetrafluoroethylene within pores between the particles, through substantially the entire axial length of the rotor body and through substantially its entire radial thickness at all points along said length.

* * * * *